US006617771B2

(12) United States Patent
Amirav

(10) Patent No.: US 6,617,771 B2
(45) Date of Patent: Sep. 9, 2003

(54) ELECTRON IONIZATION ION SOURCE

(76) Inventor: Aviv Amirav, 5 Ha'Yaar Alley, Hod Hasharon 45269 (IL)

( * ) Notice: Subject to any disclaimer, the term of this patent is extended or adjusted under 35 U.S.C. 154(b) by 0 days.

(21) Appl. No.: 10/056,104

(22) Filed: Jan. 24, 2002

(65) Prior Publication Data

US 2003/0137229 A1 Jul. 24, 2003

(51) Int. Cl.[7] ..... H01J 17/26
(52) U.S. Cl. ..... 313/231.31

(58) Field of Search ..... 313/231.31, 359.1, 313/362.1, 231.01, 85

*Primary Examiner*—Vip Patel
(74) *Attorney, Agent, or Firm*—J. Harold Nissen; Lackenbach, Siegel LL

(57) ABSTRACT

The invention provides an ion source, including an inlet port for introduction of a sample into the ion source; an outlet port through which an ion beam exits; an ionizer for ionizing the sample; an ion formation chamber confined by an ion cage, and at least one electrical shield for shielding the ion chamber from the penetration of electrical fields affecting the ions inside the chamber.

11 Claims, 1 Drawing Sheet

ELECTRON IONIZATION ION SOURCE

FIELD OF THE INVENTION

The present invention relates to ion sources.

BACKGROUND OF THE INVENTION

Ion sources are widely used in a broad range of instruments, such as ionization gauges, ion guns, mass spectrometer-based residual gas analyzers, gas chromatography mass spectrometry (GC-MS), liquid chromatography mass spectrometry (LC-MS) and more. Various ionization mechanisms are employed in these and other ion sources, including electron ionization (EI), chemical ionization, photo ionization, surface ionization, electrospray ionization, matrix-assisted laser desorption ionization, etc. Of these ionization methods and sources, EI is one of the most widely used ion source, due to its high sensitivity, ease of generating high electron emission currents, approximate uniform ionization yield to all compounds and atoms, rich structural information in the resulting EI mass spectra, and the available extensive 70 eV EI mass spectral libraries that enable automatic compound identification.

Several types of EI ion sources are used, depending on their application. Among these, the two most widely used EI ion sources are the Nier type and Brink type ion sources.

The Nier type EI ion source is based on a closed ion cage volume with an electron emitting filament positioned outside this volume so that the ionizing electrons enter the ion cage through a narrow slit and pass the ion cage only once. A major feature of the Nier EI ion source is that the sample inside the ion cage is isolated from the filament and its degree of degradation on the hot filament is thus limited. Furthermore, the filament power is relatively low; thus, the ion source temperature can be relatively uniform and better controlled. Nier type ion sources are widely used in GC-MS instrumentation and also in some forms of LC-MS, known as particle beam LC-MS.

The Brink type EI ion source has an open ion cage structure and a longer filament that is relatively close to the ion cage. As a result, the ionizing electron emission current is higher than in the Nier type EI ion source and the ionizing electrons may travel several times inside the ion cage for increased ionization yield. However, the resulting very high ion cage temperature (typically 400–500° C.) and the highly exposed hot filament near the open ion cage preclude the use of Brink type EI ion sources in standard GC-MS and LC-MS systems. The Brink type EI ion source finds wide spread usage in ionization gauges and gas analysis mass spectrometer systems.

In recent years, a new type of GC-MS and LC-MS has been under development, based on sampling with supersonic molecular beams (SMB) and electron ionization of vibrationally cold molecules while they are in the SMB in their flight passage through a Brink type EI ion source. An important feature that emerges from the use of SMB is that, due to the directional motion of the SMB, the sample compounds are not in contact with the hot filament and ion source walls. When seeded SMB are used with a light carrier gas such as helium or hydrogen, even if a small portion of the sample compounds scatter from the filament heated ion source walls, these compounds lose their high (hyperthermal) directional kinetic energy and thus, even if ionized, the ions of thermal vacuum background compounds can be filtered out by the ion source lens system. This vacuum background filtration process is based on the difference between the ion energy of ions formed from vacuum background compounds and those that were formed from SMB species due to their added directional kinetic energy as hyperthermal neutral molecules.

The vacuum background filtration is usually performed by the introduction of an ion blocking potential along the trajectory of the analyzed ions, such as at the exit lens of the quadrupole mass spectrometer (or at another ion lens element), with a retarding voltage that is sufficient to retard the thermal vacuum background ions, but not ions of ionized SMB species. However, this filtration is inefficient with SMB species that do not have high kinetic energy, such as compounds with relatively low molecular weight, in pure SMB, or when the seeded carrier gas is relatively heavy. In these cases, the differences in ion energies between vacuum background ions and ions of beam species are too small in comparison with the apparent ion energy distribution function, and vacuum background filtration is confronted with excessive SMB ion beam intensity losses.

While the 70 eV EI mass spectra of organic compounds in SMB almost always exhibited a molecular ion peak, for certain experiments it was desirable to eliminate all the lower mass fragment ions and remain only with the molecular ion. The standard way to achieve this soft ionization is to lower the electron energy. However, the reduction of the electron energy resulted in a reduction of the ionization cross-section, combined with an annoying further observation of significant reduction in the electron emission current. The reduction of ionizing electron emission current resulted from increased space charge effect between the filament and ion cage, which had a lower electrical field between them upon the reduction of the electron energy. This reduction in ionizing electron emission current can be especially significant (a few orders of magnitude) if one wishes to obtain only a few electron volts of electron energy for negative ion formation through electron attachment, and complex and expensive electron guns or other electron sources must be used for this purpose.

DISCLOSURE OF THE INVENTION

While working with a fly through Brink type EI ion source with a GC-MS system based on sampling with SMB, it was observed that the process of background ion filtration was incomplete and that the observed ion energy distribution function was broader than expected. Furthermore, the optimal ion source lens system voltages significantly deviated from what was found with computer-based simulations of the ion trajectories. Since these observations could not be accounted for, they were ignored for over a decade.

It was finally realized that these adverse phenomena and the inability to explain them resulted from the inappropriate assumption that the central ion cage element was unaffected by external fields. These conclusions emerged from unexpected results of experiments aimed at testing the optimal filament position in a standard Brink-type ion source. A more careful computer simulation of the electric field distribution inside the ion cage later revealed that the field inside the ion cage was not zero, and that external fields of the filament and of the electron emission repeller penetrated inside the fine mesh of the ion cage wall. The penetration of the field of the filament was especially undesirable, since it was close to one side of the ion cage and thus created an asymmetry in the ion trajectories as the ions were attracted to the filament side that had lower electrical potentials.

Based on these observations and conclusions, a new and improved EI ion source was constructed, in which the assumption of close to zero internal ion cage electric field is better fulfilled. The additional, new key element in this ion source is a second external field-insulating cage between the internal ion cage and the electron-emitting filament and electron repeller. Despite the fact that the addition of a second cage was initially thought to lower sensitivity, due to ionizing electron current losses on the second cage, and the increased distance between the filament and the inner cage could lead to increased deviation of the ionizing electron trajectories from the center of the inner cage, it has been found that these prior concerns are invalid.

In accordance with the present invention, there is therefore provided an ion source, comprising an inlet port for introduction of a sample into the ion source; an outlet port through which an ion beam exits; means for ionizing said sample; an ion formation chamber confined by an ion cage, and at least one electrical shield for shielding said ion chamber from the penetration of electrical fields affecting the ions inside said chamber.

BRIEF DESCRIPTION OF THE DRAWING

The invention will now be described in connection with certain preferred embodiments with reference to the following illustrative figure, so that it may be more fully understood.

With specific reference now to the figure in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawing making apparent to those skilled in the art how the several forms of the invention may be embodied in practice.

In the drawing:

FIG. 1 is a schematic diagram of a dual cage EI ion source according to the present invention.

DETAILED DESCRIPTION

Figure 1:
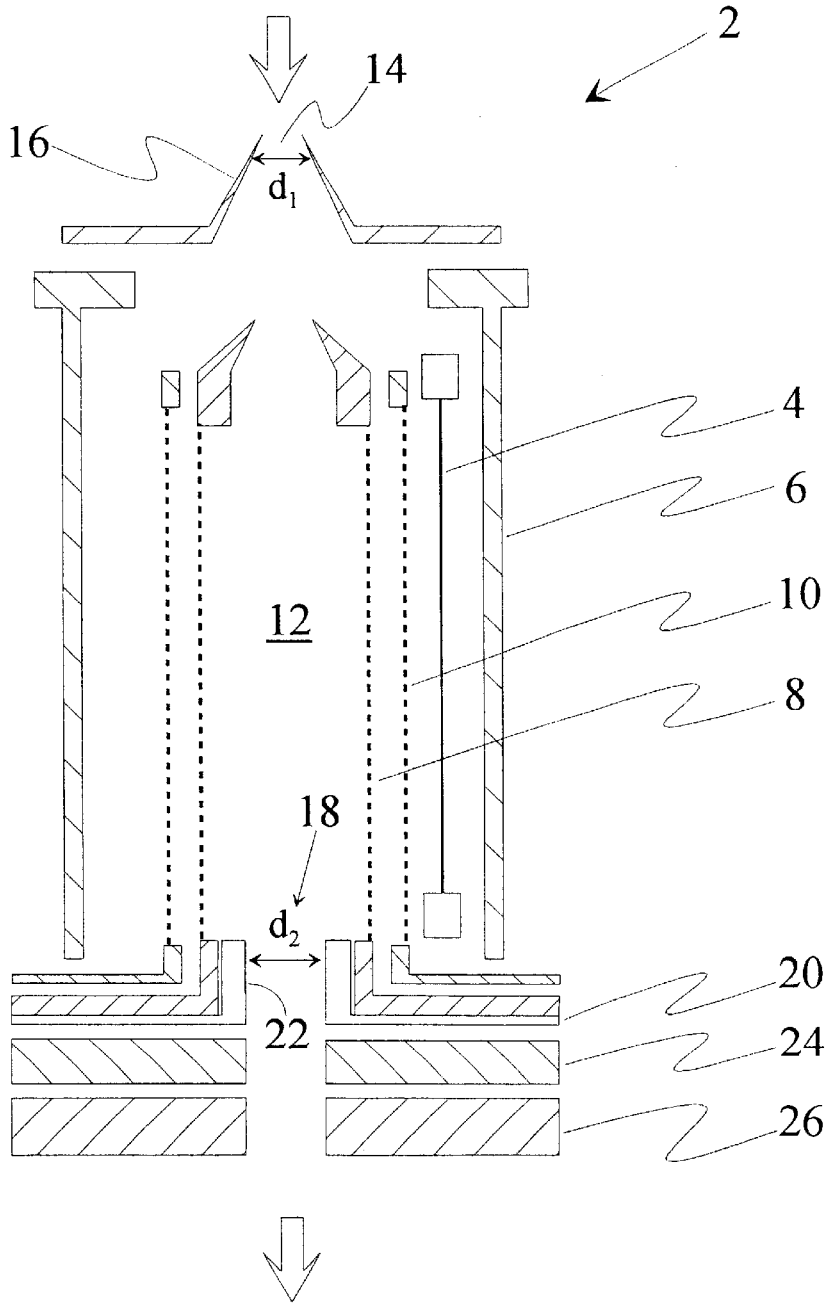

FIG. 1 schematically illustrates a tubular, dual cage EI ion source 2. A thoriated tungsten ribbon filament 4, advantageously having a width of 0.75 mm, a thickness of 25$\mu$ and a length of 30 mm, serves as an electron emitter, producing a typical emission current of 10 mA. Preferably, filament 4 is initially carborized for achieving higher emission currents at lower filament temperatures. The ionizing electrons are repelled by an electron repeller 6, biased 30–150 V below the filament potential.

Surrounding the commonly used internal cage 8, there is provided a second, external cage 10, biased positively in comparison with the potential on the filament 4, and thus forming a dual-cage ion source. Ionization is performed in chamber 12 within internal cage 8.

Ion source 2 has an input port 14, preferably constituted by a molecular beam collimator 16, serving for collimation and spatial definition of the molecular beam of a sample introduced via the input port and propelling axially through the ion source. Typically, the diameter $d_1$ of the beam collimator is 2.3 mm. At the opposite side of the ion source 2, there is formed an output port 18, advantageously constituted by a disk 20 positioned at the bottom of the ion source, having a tubular portion 22 projecting toward chamber 12. Typically, the diameter $d_2$ of output port 18 is 4.5 mm, the diameter of internal cage 8 is 10 mm, and the diameter of external cage 10 is 14 mm. The mounting clamps for filament 4 and electrical insulators are not shown.

During a typical operation, the filament 4 is biased on −66 V for achieving 70 eV electron energy, the external cage 10 is biased at +5 V, and the internal ion cage 8 is biased at +4 V, which constitutes the electrical ion energy applied. The actual ion energy, however, is 4V+the initial kinetic energy of the neutral beam compounds. Both cages 8 and 10 are made of fine, 50-mesh, gold-coated tungsten (25$\mu$ wire diameter and 0.5 mm unit cell length) having 90% electron transmission and mounted on three tungsten rods having a diameter of 0.5 mm. The heated filament emits electrons that are attracted to the external cage 10 and then travel to and through chamber 12 within inner ion cage 8. Upon the scattering of electrons from the sample compounds, ions are formed. These ions can be slightly attracted by a focusing lens 24, having a low voltage of 0–2 V, for their attraction and extraction. There is also provided an ion lens 26, which serves for background ion filtration by low voltage biasing. For achieving effective background filtration, a low positive voltage such as 0.3 V is applied to the outer ion lens 26, serving to practically eliminate residual vacuum background ions, while transmitting ions with initial directional neutral kinetic energy above this value. The ion cage 8 has a close to zero field inside it; thus, ions formed from thermal vacuum background compounds are not extracted and are eventually neutralized. On the other hand, ions formed from species in a supersonic molecular beam move axially to the ion source lenses 24, 26 and are extracted with minimal vacuum background.

Advantages of the Dual Cage EI Ion Source

The dual cage ion source 2 has been tested and it performed well and in full agreement with computer-based ion trajectory simulations. It was found that the addition of a second, external cage, i.e., cage 10, shields the internal ion cage 8 and, as a result, the ion source 2 possesses several unique features, providing the following advantages over the standard Brink type ion source:

1) Improved background ion filtration is achieved. Thus, there is a lower magnitude of chemical noise. The proper shielding of the ion cage resulted in considerably narrower ion energy distribution function. As a result, only +0.3 V is required to be applied to ion lens element 26 for the full elimination of thermal ions formed from the vacuum background. Without the addition of the outer cage, about +2 V were required. This feature is desirable for GC-MS with SMB. In addition, it is especially useful for LC-MS with SMB, in view of the considerably lower kinetic energy of its SMB species, due to the use of methanol or water as the carrier gas instead of the much lighter helium or hydrogen.
2) The obtainable emission current is, surprisingly, slightly improved, despite the addition of the second cage. This emission current increase originates from the ability to locate the filament closer to the second cage than it is in the standard EI ion source to the ion cage, since we were not concerned with filament field penetration into the ion cage. A closer filament position results in a higher electron extraction field for a given voltage difference between the filament and outer cage and thus, there is less space charge hindrance. Furthermore, a more open mesh was used, having 90% transmission instead of 80%, to compensate for the loss of emission due to the added second cage, since the ion cage was properly shielded and thus did not require a dense mesh Faraday cage.

3) The resulting ion beam optics were improved and had straight axial trajectories; thereby, the ion signal was increased, mostly due to reduced filament potential penetration to the ion cage and the elimination of its attraction effect on the ion trajectories.
4) The operational (signal) reproducibility and long term stability were improved, since variations in the position of the filament due to its thermal expansion and aging did not affect the ion trajectories and ion optics. In time, and depending on the composition of residual vacuum compounds and analysis history, the filament work function may change and accordingly the filament temperature which is required to provide a given predetermined electron emission current, may also change. As a result, the filament may expand at higher temperatures, change its position, and consequently, the resulting magnitude of field penetration into the ion cage will change, in a single cage design.
5) The obtained mass spectra are more reproducible and have lower mass spectral distortion, due to lower losses of low mass fragments through the background filtration process.
6) Increased maximum emission current are obtained at low electron energies. In fact, both the repeller and outer cage potentials may be biased on the filament potential and thus, a change of the electron energy will not produce any change in the electrical fields between the filament and the outer cage. The emission current is thus uniquely unaffected, due to variations of the electron energy. This feature is of considerable importance for achieving soft EI with molecular ion only at low electron energies and for obtaining effective negative ion EI through low electron energy electron attachment.
7) Fast automated switching between 70 eV and 20 eV electron energies (or any other electron energy value, including scanning of the electron energy) is achieved, since the filament heating current may now become independent on the electron energy. This feature can serve for alternate scans switching of the electron energy in GC-MS or LC-MS with SMB.
8) The addition of the second cage enables the use of a longer filament in a circular filament configuration since the diameter of the filament circle is larger, as it relates to a given distance from the larger outer cage instead of the inner cage. Circular filament mounting is advantageous over axial filament mounting when a short ion source is desirable in order to be closer to the supersonic nozzle for the ionization of higher molecular beam density and thus achieve improved ionization efficiency. On the other hand, the proper mounting of a circular filament is more difficult than that of a straight filament. The use of a circular filament was tested, and it was found that its performance is independent on its location along the ion cage axis and is similar to that of the standard axial filament. However, upon positioning the circular filament near the entrance of the ion source, a larger SMB collimator can be used, having an anticipated higher ionization yield at the price of increased SMB carrier gas load on the ion source vacuum chamber.

Improved ion beam intensity, by a factor of 2.6+−0.6, was measured with the dual cage ion source, over the same ion source without the outer cage. This sensitivity enhancement factor was measured through the delivery of a constant flux of hexadecane into the ion source using a direct sample introduction device, as well as through single ion monitoring results with GC-MS analysis of pyrene, using a GC-MS with SMB. Furthermore, the vacuum background noise was also reduced and thus, the signal-to-noise ratio measured with the GC-MS analysis of pyrene was improved by a factor of 6.4+−2, in comparison with the performance of the same ion source with a single cage. With electron energies below 20 eV, the sensitivity improvement factor was lower than expected, since while the emission current could be higher, the adverse effect of filament field penetration with a single cage ion source was lower at low electron energies. The actual gain in sensitivity depended on how low the electron energy was.

This ion source was used with electrons for sample ionization. However, it is easy to realize that photons provided by either a lamp or a laser can also be used for sample ionization, especially in SMB, for achieving superior background ion filtration and sensitivity. The ionizing photons can be introduced axially or perpendicular to the ion cage, directly through the dual cage meshes. While a heated filament is the most convenient source of electrons, plasmas can also be employed for the provision of large currents of ionizing electrons. A plasma electron source involves high electrical fields and thus can induce field penetration into the ion cage, which is minimized with the dual ion cage configuration.

While the additional cage was used for the elimination of filament and electron repeller field penetration into the ion cage, this shielding can also be achieved by other means. For example, one can use a denser mesh at the ion cage, with the sacrifice of reduced ionizing electron current inside the ion cage and substantially reduced contribution of electron multiple paths to the ionization efficiency. It is noted that since the outer cage is positioned about 2 mm around the inner cage, the dual cage design provides much better shielding against external field penetration than a single mesh with the same transmission as that of the two cages of the dual cage ion source. This observation is understood in terms of the greater distance of the filament from the inner cage, and the fact that two separated cages provide more effective electrical shielding than a single cage with a mesh of twice the thickness. Naturally, three or more cages can also be provided for even better shielding, however, usually this is not required.

A larger ion cage volume can be used for better shielding of the central volume of the beam species, but this may also result in increased ionization of the vacuum background and thus more noise. Furthermore, the filament can more easily lose its proper orientation with respect to the center of the cage and induce background ionization instead of preferential SMB species ionization. A single cage ion source with ion cage diameter of 14 mm exhibited surprisingly poor performance in comparison with a 10 mm diameter single cage, due to suspected internal space charge effects that are not fully understood. The electron source can be further removed from the ion cage and even a separate electron gun can be used for the elimination of the filament potential penetration, at a cost of increased complexity. However, only the dual cage design is capable of providing all of the improvement features described above.

The dual cage ion source can be effectively used with a few advantages in several applications, including:
1) GC-MS with supersonic molecular beams.
2) LC-MS with supersonic molecular beams. In this system, the SMB species kinetic energy is limited in view of the use of methanol, water or acetonitrile vaporized solvents as the carrier gas. Thus, the achievement of vacuum background filtration is more challenging and therefore the use of this ion source in LC-MS with SMB system is desirable.

3) Negative ion source. The considerably higher low electron energy electron current can substantially improve the negative ion formation yield and provide an effective electron attachment negative ion source.

4) Molecular beam detection. While with hyperthermal supersonic molecular beams, vacuum background filtration can be relatively easily achieved, based on the large difference in ion energies at the ion cage, this filtration is much harder to achieve with pure (unseeded) supersonic or other types of molecular beams. However, the feature of a close to zero field in the ion cage with the dual cage EI ion source could enable vacuum background filtration even for the lower energy beam compounds in pure SMB.

5) Chemical process studies. In many cases the products of chemical reactions, photo dissociation, high-energy electron, ion, or atom-induced surface sputtering, or any other energetic chemical processes may lead to species with some directional kinetic energy. With the dual cage ion source, even a small amount of initial axial ion energy can be used for achieving vacuum background filtration and thus considerable improvement in the achievable signal-to-noise ratio and measurement sensitivity.

6) In ion guns based on the use of supersonic molecular beams, the achievement of vacuum background filtration can help in the chemical purification of the ion beam and also improve its collimation and narrow its ion energy distribution function.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An ion source, comprising:

an inlet port for introduction of a sample into the ion source;

an outlet port through which an ion beam exits;

means for ionizing said sample;

an ion formation chamber confined by an ion cage, and at least one electrical shield for shielding said ion chamber from the penetration of electrical fields affecting the ions inside said chamber.

2. The ion source as claimed in claim 1, wherein said inlet port is a molecular beam collimator.

3. The ion source as claimed in claim 1, wherein said outlet port further comprises at least one ion beam focusing lens, for controlling the trajectory of ions exiting said ion source.

4. The ion source as claimed in claim 1, further comprising an ion filter located at the trajectory of ions exiting said ion source.

5. The ion source as claimed in claim 1, wherein said electrical shield is constituted by an open mesh cage surrounding said ion cage.

6. The ion source as claimed in claim 1, wherein said means for ionizing the sample are electrons.

7. The ion source as claimed in claim 6, wherein said electrons are produced by a heated filament.

8. The ion source as claimed in claim 6, wherein said electrons are produced by plasma.

9. The ion source as claimed in claim 1, wherein said means for ionizing the sample are photons.

10. The ion source as claimed in claim 1, further comprising an electron repeller surrounding said shield.

11. The ion source as claimed in claim 1, wherein said sample is introduced in a supersonic molecular beam formed by expansion into vacuum through a supersonic nozzle.

* * * * *